United States Patent [19]

Guais

[11] Patent Number: 4,748,430

[45] Date of Patent: May 31, 1988

[54] AIR-COOLED HIGH-FREQUENCY CURRENT TRANSFORMER

[75] Inventor: Noêl Guais, Cholet, France

[73] Assignee: Thomson-CGR, Paris, France

[21] Appl. No.: 931,087

[22] Filed: Nov. 17, 1986

[30] Foreign Application Priority Data

Nov. 19, 1985 [FR] France ..... 85 17084

[51] Int. Cl.[4] ..... H01F 15/04; H01F 27/28

[52] U.S. Cl. ..... 336/84 C; 336/223; 336/225

[58] Field of Search ..... 336/223, 225, 221, 220, 336/55, 84 R, 84 C, 173; 324/318, 319, 320, 321

[56] References Cited

U.S. PATENT DOCUMENTS

| | | | |
|---|---|---|---|
| 2,081,979 | 6/1937 | Bentley | 336/84 C |
| 2,860,312 | 11/1958 | Krepps . | |
| 3,312,919 | 4/1967 | Ross | 336/84 C |
| 3,360,754 | 12/1967 | Gerdiman | 336/223 X |
| 3,826,967 | 7/1974 | Wilkinson . | |
| 4,176,335 | 11/1979 | Charpentier | 336/223 |
| 4,236,133 | 11/1980 | Seiersen . | |

FOREIGN PATENT DOCUMENTS

| | | | |
|---|---|---|---|
| 237735 | 1/1965 | Austria | 336/223 |
| 1133764 | 4/1957 | France | 336/223 |

OTHER PUBLICATIONS

IBM Technical Disclosure Bulletin, "Flat Winding Transformer," J. K. Radcliffe, vol. 22, No. 9, Feb. 1980, pp. 4009–4012, 336–223.

*Primary Examiner*—Thomas J. Kozma
*Attorney, Agent, or Firm*—Oblon, Fisher, Spivak, McClelland & Maier

[57] ABSTRACT

The transformer comprises a primary coil comprising a conductive strip wound around an insulating coil base comprising a central part, two parts located at the ends of the central part with a roughly rectangular shape, the bigger sides of which extend along a second and a third direction which are mutually opposite. The length of the central part, measured along the initial direction, is determined so that the two ends have the directions of their bigger sides colinear in pairs when the central part is wound around the coil base. The two angles, formed at the points where the edges of the parts located at the ends intersect the edges adjacent to the bigger sides of the central part, are truncated to prevent the overlapping of the two ends when the central part is wound around the coil base.

5 Claims, 1 Drawing Sheet

AIR-COOLED HIGH-FREQUENCY CURRENT TRANSFORMER

The present invention pertains to an air-cooled high-frequency current transformer.

BACKGROUND OF THE INVENTION

It is more especially applied in the manufacture of transformers without magnetic cores for medical instruments used for the formation of optical images by magnetic resonance. It is known that, to make these devices function properly, it is desirable to eliminate factors that cause distortions in the field lines of the magnet which is incorporated into these devices. However, at the operating frequencies (6 to 30 MHz) of these instruments, the techniques of the prior art for building current transformers entail the use of ferrite magnetic circuits to obtain efficient magnetic coupling between the primary and secondary coils of the transformers. These manufacturing techniques naturally run counter to the design requirements of instruments for optical image formation by magnetic resonance. This is because the presence of a ferrite current transformer can naturally give rise to distortions in the field lines of the magnet in instruments for optical image formation by magnetic resonance.

SUMMARY OF THE INVENTION

The purpose of the invention is to obviate the above disadvantages.

To this end, the object of the invention is an air-cooled, high-frequency transformer comprising:

- a primary coil formed by a conductive strip wound around an insulating coil base, comprising a central, rectangular part, the bigger sides of which extend along an initial direction, and two parts, located at the ends of the central part, with a roughly rectangular shape, the bigger sides of which extend along a second and a third direction, these two directions being mutually opposed, the length of the central part measured along the initial direction being determined so that, at the two ends, the directions of their bigger sides are colinear in pairs when the central part, taken along the initial direction is wound around the coil base, wherein the two angles formed at the intersection of the parts located at the ends with the edges adjacent to the bigger sides of the central part are truncated in order to avoid the overlapping of the two ends when the central part is wound around the coil base,
- a secondary coil with N continguous turns made of enamelled wire wound on top of the conductive strip.

The main advantage of the invention is that it can be used to make air-cooled, high-frequency current transformers in which the maximum coupling can be obtained between the primary and secondary coils, thus partially compensating for the absence of the magnetic circuit.

Futhermore, the special shape of the conductive strip, which prevents the overlapping of the ends of the turn, gives maximum efficiency to this turn along its full extent, while doing away with the need for putting insulation layers between the ends, an operation which would diminish the quality of the magnetic coupling between the primary and the secondary coil.

The shape given to the primary turn also ensures that the primary and secondary coils are wound to a constant thickness around the coil base and thus make it possible to obtain the optimum coupling.

BRIEF DESCRIPTION OF THE DRAWINGS

Other characteristics and advantages of the invention will appear from the following description which is made with reference to the appended drawings, namely.

DESCRIPTION OF THE PREFERRED EMBODIMENT

Figure 1:
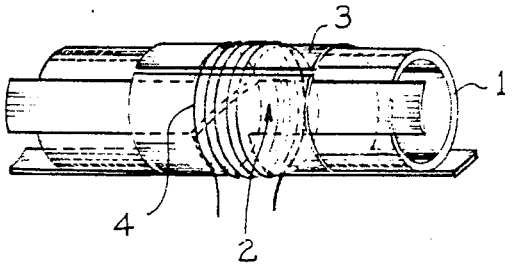
FIG. 1: a perspective view of a current transformer according to the invention.
Figure 2:
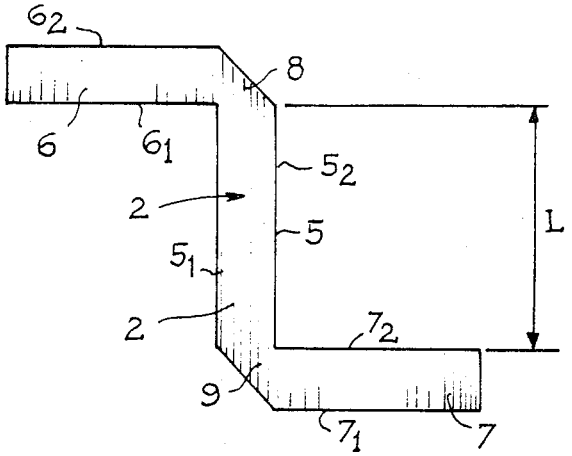
FIG. 2: a plane view of a mode of embodiment of a conductive strip to obtain the primary coil of the transformer according to the invention.

The current transformer according to the invention, depicted in FIG. 1, comprises a coil base 1 made of plastic material or any other equivalent, insulating material on which the following are wound in succession: a primary coil 2, a metallic shield 3 and a secondary coil 4. The primary coil 2 comprises a strip which is cut out of a sheet of metal foil along the S-shaped line depicted in FIG. 2 and then wound around the coil base 1. The strip depicted in FIG. 2 comprises a central part 5 with a roughly rectangular-shaped part and two other parts 6 and 7, also roughly rectangular in shape, which extend along two mutually opposite directions at the ends of the central part. In FIG. 2, the directions of the bigger sides $6_1$ and $6_2$ on the one hand, and of the sides $7_1$ and $7_2$ on the other hand, of the rectangular parts 6 and 7, are perpendicular to the direction of the bigger sides $5_1$ and $5_2$ of the rectangle forming the central part 5.

Figure 3:
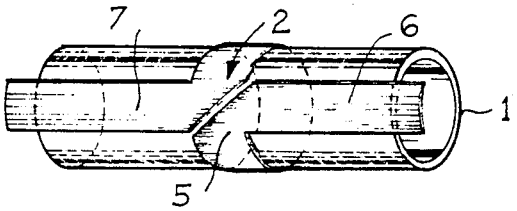
FIG. 3: a depiction of a conductive coil mounted on a coil base of a transformer according to the invention

The length L of the bigger sides $5_1$ and $5_2$ of the central part is determined so that the ends 6 and 7 are an extension of each other when the central part 5 is wound around the coil base 1 and the angles formed by the adjacent edges of the strip corresponding firstly, to the sides $5_2$ and $6_2$ and secondly, to the sides $5_1$ and $7_1$ are truncated in one and the same direction, for example at 45° with respect to the direction of the sides $5_1$ and $5_2$, to form the edges 8 and 9 of FIG. 2 and prevent the overlapping of the ends of the central part 5 when this part is wound around the coil base 1 in the way depicted in FIG. 3.

Figure 4:
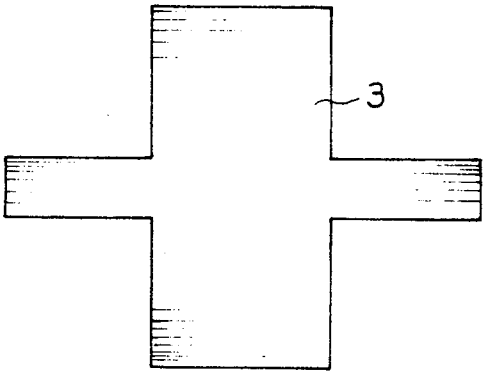
FIG. 4: a mode of embodiment of the insulating shield of the transformer depicted in FIG. 1.

The shield 3, depicted in FIG. 4, is used to provide the transformer with electrostatic shielding and to restrict parasitical capacitances between the primary coil and the secondary coil. The insulation between the shield 3 and the primary and secondary coils is done in a way known to the prior art using PTFE (p.e. teflon) or adhesive paper.

What is claimed is:

1. Air-cooled, high-frequency current transformer comprising, a primary coil made up of a conductive strip wound around an insulating coil base comprising a rectangular central part, the bigger sides of which extend along an initial direction and two parts located at the ends of the central part, with a roughly rectangular shape, the bigger sides of which extend along a second and a third direction which are mutually opposed, the length of the central part measured in the initial direction being determined so that the directions of their bigger sides are colinear in pairs when the central part, taken along the initial direction, is wound around the coil base, wherein the two angles formed at the points where the edges of the parts located at the ends intersect the parts adjacent to the bigger sides of the central part are truncated to prevent the overlapping of the two ends when the central part is wound around the coil base and, a secondary winding with N contiguous turns made of enamelled wire wound on top of the conductive strip.

2. Transformer according to the claim 1 wherein the second direction and the third direction form a right angle with the initial direction.

3. Transformer according to the claim 2 wherein the coil base comprises a tube made of plastic material.

4. Transformer according to the claim 3 further comprising a shield placed between the primary coil and the secondary coil.

5. Transformer according to the claim 4 wherein the strip is cut out of a sheet of copper foil.

* * * * *